United States Patent [19]

Vallee

[11] 4,014,152

[45] Mar. 29, 1977

[54] SHEET METAL ROOFING SYSTEM

[76] Inventor: Louis Léonce Vallee, 6392 Maubourg Ave., Montreal, Quebec, Canada H1M2C8

[22] Filed: Dec. 4, 1975

[21] Appl. No.: 637,597

[52] U.S. Cl. ..... 52/588; 52/520; 52/528

[51] Int. Cl.[2] ..... E04D 1/00

[58] Field of Search ..... 52/588, 528, 529, 520

[56] References Cited

UNITED STATES PATENTS

| | | | |
|---|---|---|---|
| 466,850 | 1/1892 | Goodwin | 52/528 |
| 1,292,960 | 1/1919 | Owens | 52/528 |
| 3,047,111 | 7/1962 | Clements et al. | 52/520 |
| 3,608,267 | 9/1971 | Curran | 52/588 |
| 3,733,767 | 5/1973 | Craik | 52/588 |

*Primary Examiner*—J. Karl Bell
*Attorney, Agent, or Firm*—Larson, Taylor and Hinds

[57] ABSTRACT

A roofing system of the batten type using sheet steel components formed of elongated pan sections. Each pan section has a wide flat elongated central region which lies flat on the roof and is centrally located between upstanding side walls running the full length of the central region. One side wall is formed of a single walled structure, while the other parallel side wall is formed of a partial rectangular inverted channel wherein the sheet metal is folded back on itself to provide a double wall thickness to the channel, and the marginal edge of the sheet metal is projected outwardly beyond the outermost wall of the double walled structure and in planar alignment with the central region of the pan section and adapted to be fastened to the roof by fasteners located at spaced intervals along its length. Each pan section is adapted to be longitudinally engaged with an adjacent pan section with the single walled structure side wall of one pan section engaging within the double walled structure side wall of the adjacent pan section, the central region of one pan section overlying the nailed down marginal edge of the adjacent pan section. The engaged side walls of adjacent pan sections form the batten-like portions of the covered roof and have great strength and rigidity to resist dislodgement of the roofing by wind force.

5 Claims, 10 Drawing Figures

SHEET METAL ROOFING SYSTEM

This invention relates to a metal roofing system to be installed on roofs having at least a slight slope, and in particular to roofs of the batten type.

Metal roofs are well known and one of the conventional metals used in roof covering is copper in sheet form which can be nailed directly to the underlying wooden structure and the nails can be waterproofed by brazing. The adjacent sheet metal components can also be brazed together. The appearance is enhanced when regularly spaced apart battens are used which facilitates the installation of the roof and also the repair work that may have to be done from time to time. However, brazing is time consuming and requires skilled labour with the result that conventional batten copper roofs are prohibitive to family housing projects.

Various attempts have been made to design metal roofing systems where the individual components are nailed or screwed to the underlying structure, but where no soldering is required due to the use of covering and overlapping technique. Examples of such metal roofing systems of recent design will be found in U.S. Pat. No. 3,603,056 to Roth, issued on Sept. 7, 1971 and U.S. Pat. No. 3,767,121 to Herman, issued on Oct. 2, 1973. However, all known prior metal roofing systems either lack in waterproofing or were found to be insufficiently rigid except when using comparatively thick sheet metal or, in the case of soldered copper roofing, are prohibitively expensive.

The object of this invention is to provide a metal roofing design which is cheap to manufacture and easy to install without the need to braze or weld the parts together and which is sufficiently rigid even when using thin, prepainted aluminum sheet material and which will be comparable from the point of view of outside appearance, durability and waterproofing as the conventional copper roofing of the batten type.

A further object of the invention is to provide a metal roofing design including spaced apart battens without the use of wood battens normally used and secured to the underlying roof before the metal roof is installed.

I have found that these objects can be fully satisfied in a roofing system of the batten type where the main elements, hereinafter referred to as pan sections, have a wide flat elongated central region with two upstanding side walls, one of which in section is an inverted single wall structural section, while the opposite side wall is formed by folding of the sheet metal on itself to form a double walled inverted rectangular structural channel inwardly of the edge of the sheet of metal where the outer free wall of the rectangular channel extends downwardly part way to leave a gap between the lower edge of the outer free wall and the extended longitudinal strip of the pan section. The extended longitudinal strip extends outwardly from the inner double wall a distance beyond the plane of the double outer free wall of the channel and is drilled at intervals along its length and is held down on the underlying roof by screws. The single wall side wall of one pan section can be slid longitudinally into locking engagement with the double walled side wall of a pan section already secured to the roof, with the central region of one pan section covering the secured longitudinal strip of an adjacent pan section.

Thus this invention provides a metal roofing system of the batten type comprising a plurality of pan sections, each having a central region and two vertically projecting side walls which interlock with the side walls of adjacent pan sections to form parallel multi-walled spaced apart battens of great strength and rigidity. One longitudinal edge of each panel section forms a narrow marginal strip for driving fasteners therethrough into the underlying roof, there being no other fasteners to hold said pan sections in place on said roof. For a proper fit, the edges of the peripheral pan sections are cut to be slightly in excess of the adjacent eave starter and are folded downwardly and then inwardly underneath the protruding flange of the eave starter.

An exemplary embodiment of this invention will now be described in detail with reference to the accompanying drawings wherein.

Figure 1:
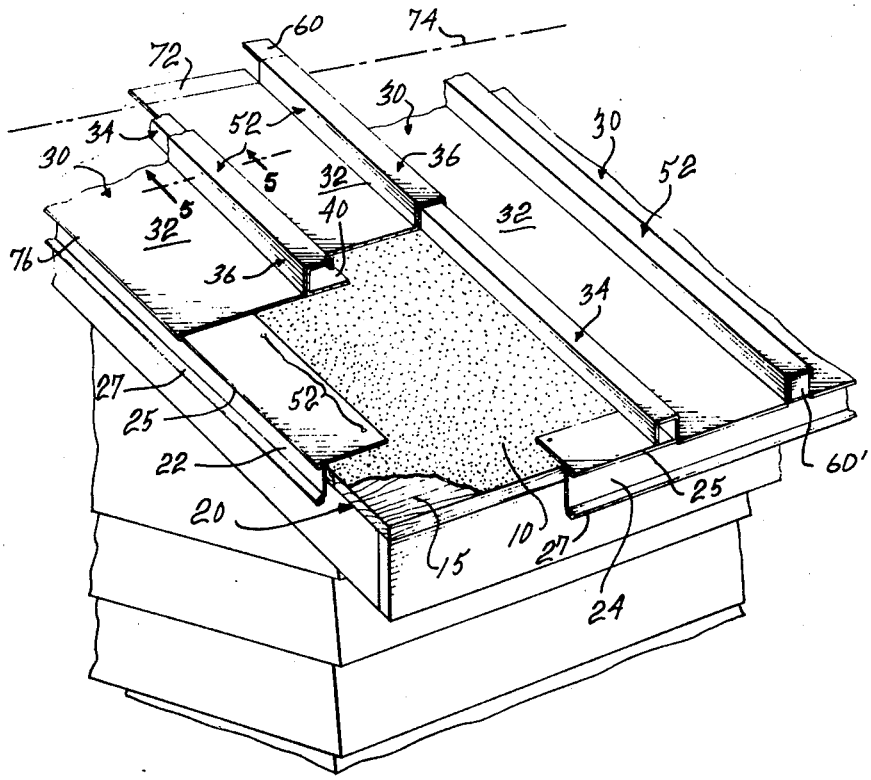
FIG. 1 is a perspective view of a corner of a sloping roof with a metal roofing system according to the present invention, some of whose parts have been removed or cut away for illustrative purposes.

Referring to the drawings, an improved metal covering for roofs is illustrated which comprises a layer of waterproof paper, such as tar paper 10, laid over the bare upper surface 15 of an at least slightly sloping roof 20.

Peripheral eave starters, including gable starter 22 and eave starter 24, are disposed over the marginal edges of the waterproof paper 10 and have a protruding flange 25 which extends slightly beyond the edges of the roof surface starters 22, 24, at least partially cover the facing of the roof and include a downwardly and outwardly extending flange 27, all of which being standard in the trade of roof covering.

Figure 2:
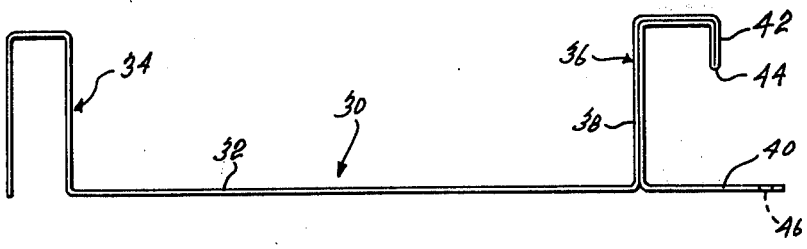
FIG. 2 is an enlarged end view of a pan section incorporating the elements of the batten structure illustrated in FIG. 1.
Figure 3:
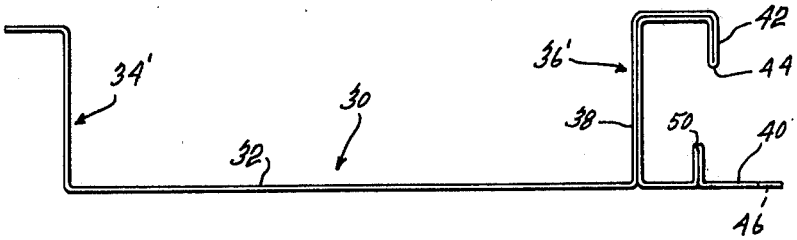
FIG. 3 is a view similar to FIG. 2, but showing a modified form of a pan section.
Figure 4:
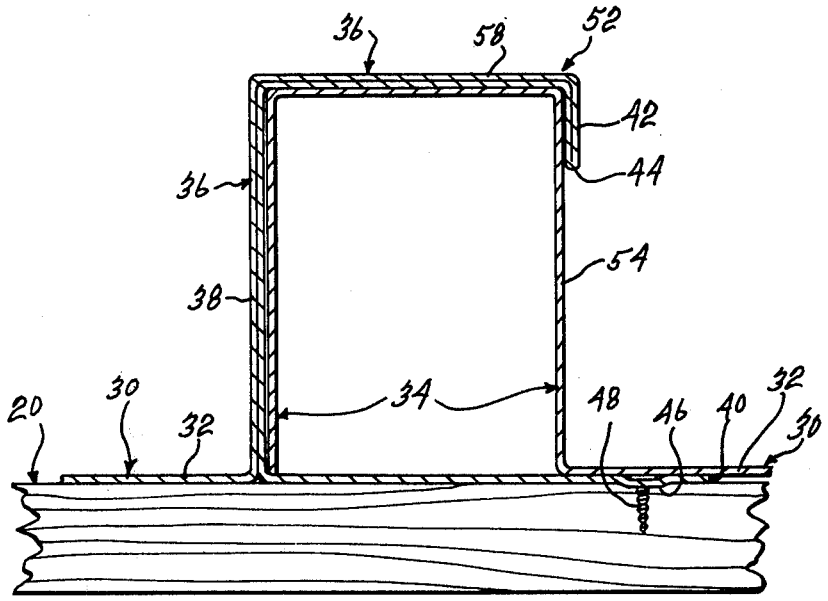
FIG. 4 is an enlarged partial cross-sectional view of a pan section of the roofing, taken on the line 4—4 of FIG. 1, showing the interlocking structure of adjacent pan sections to form a batten.

Referring now particularly to FIGS. 2, 3, 4 and 5 of the drawings but first to FIGS. 2 and 4, a plurality of pan sections 30 formed of sheet material are secured to the roof 20 over the layer of waterproof material 10. Each pan section 30 has a central region 32 which is flat and elongated. One longitudinal edge portion of the pan section 30 is folded upwards then outwardly and then downwards to form an upstanding inverted rectangular channel side wall 34, while the opposite longitudinal edge portion is folded upwards, then outwards and then downwards and is then doubled back on itself and folded to lie under the already folded portions to form an upstanding double walled inverted rectangular channel side wall 36. The remaining portion of the sheet material is then folded upwards and outwards at right angles to the double wall 38 of the side wall 36 into the plane of the central region 32 of the pan section 30 to form a securing strip 40 projecting beyond the outer facing double wall 42 of the side wall 36.

The outer facing wall 42 of the side wall 36 has its lower edge 44 spaced upwardly from the plane of the securing strip 40.

The pan section securing strip 40 is drilled or punched at 46 at spaced intervals, outwardly of the outer facing wall 42, to receive the securing screws 48 holding the strip and the pan section 30 to the roof 20.

Figure 5:
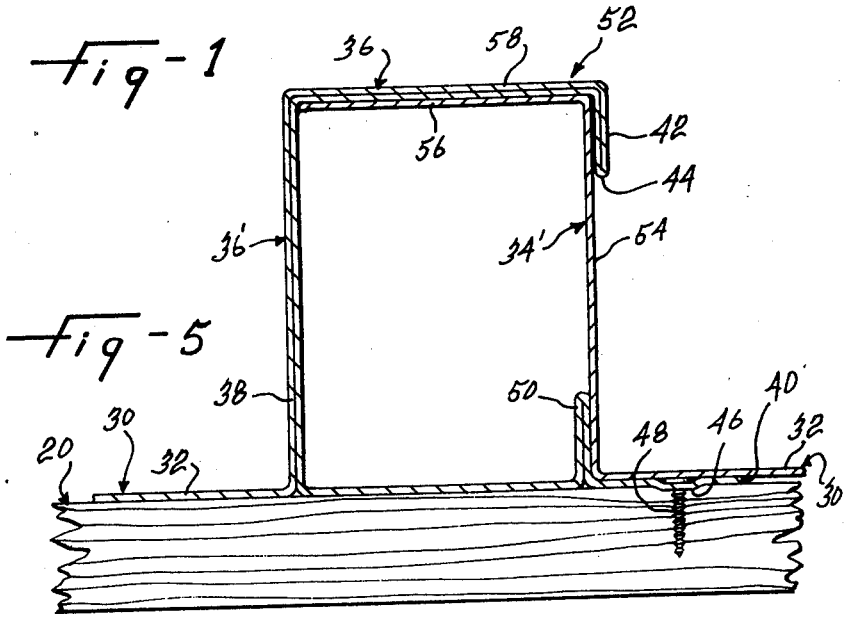
FIG. 5 is a view similar to FIG. 4, showing an alternative form of batten making use of the pan section shown in FIG. 3.

In FIGS. 3 and 5 the pan section 30' is similar to the pan section 30 shown in FIG. 2, except that the side wall 34' is projected upwardly and outwardly only and the securing strip 40' is folded upwardly on itself to form a stop 50.

In both FIGS. 2 and 3 the transverse width of the side walls 34 or 34' of one pan section can slide inside the side walls 36 or 36' of an adjacent pan section in the manner shown more clearly in FIGS. 4 and 5 and combine to form a multi-walled hollow batten 52 of great strength and rigidity.

The stop 50 shown in FIGS. 3 and 5 can be applied also to the form of pan section shown in FIGS. 2 and 4. The stop 50 is located so as to hold the vertical wall 54 of the side wall 34 or 34' in alignment with the inner surface of the wall 42 of the side wall 36 or 36', and with the edge of the horizontal wall 56 abutting the double wall 38 of the side wall 36 or 36', thus maintaining the rectangular shape of the hollow batten 52. The stop 50 is also of considerable assistance as a guide in sliding the side wall 34 of one pan section within the side wall 36 of an adjacent pan section.

Figure 10:
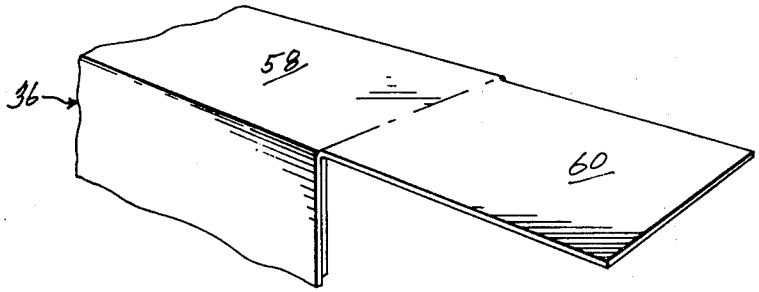
FIG. 10 is a perspective view showing a batten end closing extension of a channel wall of a pan section.

The top surface 58 of the side walls 36 are extended at 60 as shown in FIGS. 1 and 10 and these extensions 60 on one side of the roof overlap the top surface of the battens 52 on the opposite side of the roof. Also, the upper ends of the double walls 38 and 42 of the side walls 36 of the battens on one side of the roof can be cut at an angle so as to abut with similarly cut side walls of the battens on the opposite side of the roof.

In similar manner the top surface 58 of the side walls 36 are extended at the lower end of the battens 52 and these extensions are folded down at 60' to close off the lower open end of the battens and be secured to a block of wood which has been driven into the open end of the batten 52. Also, the side walls 34 and 36 can be extended and be folded over to reinforce the member 60' in closing the open end of the batten 52.

Figure 9:
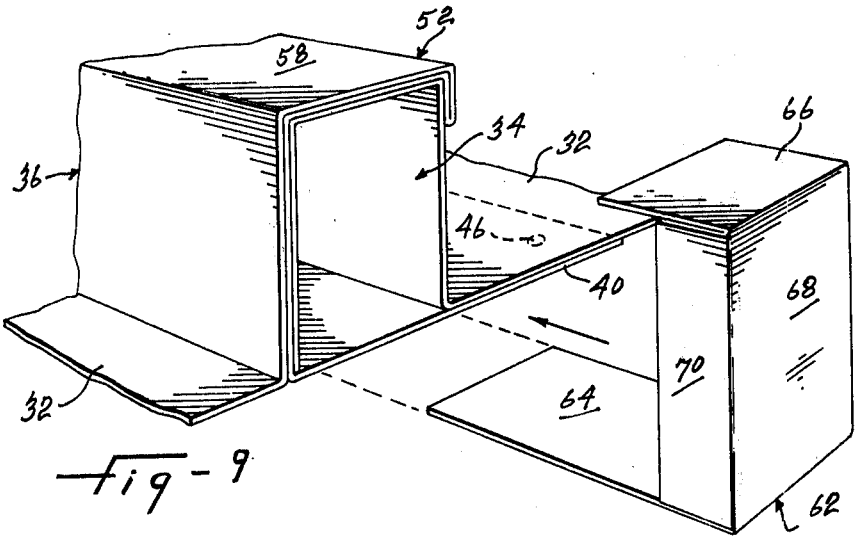
FIG. 9 is a perspective view of a member closing the lower ends of the formed battens of the roof covering.

Alternatively an end cap 62, illustrated in FIG. 9, may be employed to close the open end of the battens 52. This end cap has a lower member 64, a top member 66, an end wall 68 and a pair of side members 70, and the cap is dimensioned to fit tightly within the open end of the battens 52. The end cap 62 may be secured in place in the end of the batten 52 by means of pop-rivets through the side walls 34 and 36 of the batten.

The upper end portions 72 of the central region 32 of the pan sections 30 are extended to overlap the ridge 74 of the roof.

Figure 6:
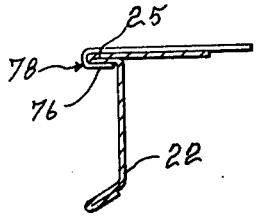
FIG. 6 is the illustration of the profile of a side gable starter.

Beyond the last composite batten 52 of the sheet metal roof, the pan sections will only have one channel wall 34 or 36 and the opposite edge 76 will be cut slightly wider than necessary so as to be bent downwardly and then inwardly as at 78, as shown in FIG. 6 to thereby cover the protruding flange 25 of the gable starter 22.

Figure 7:
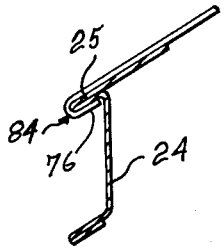
FIG. 7 is the illustration of a front eave starter.

Similarly, the lowest edge of the pan sections 30 will be cut long enough to be bent downwardly and inwardly, as shown at 84 in FIG. 7, thereby to extend over and cover the projections 86 of the eave starter 88.

Figure 8:
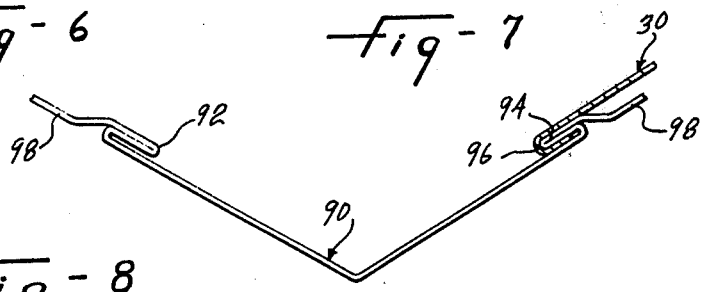
FIG. 8 is the illustration of a gully and valley flashing.

For gullies and valley flashings, a component 90 is illustrated in FIG. 8 in cross-section which also uses downwardly projecting double folds 92 and 94 for receiving a folded edge 96 of the associated pan section 30, and a narrow margin 98 beyond the double folds 92 and 94 will be used for receiving fasteners such as screws or nails.

In the assembly of the roofing above described, a first pan section 30 having only one side wall 36 is laid on the roof adjacent to one gable end and is secured thereon by the screws 48. The edges of this pan section 30 has its edges formed as at 78 and 84 for engagement with the gable starter 22 and with the eave starter 24.

An adjacent pan section 30 has its upper end aligned with the lower end of a pan section already secured on the roof so that its side wall 34 is aligned with the side wall 36. The pan section is then pushed upwards with its side wall 34 sliding within the side wall 36 and with its central region 30 sliding over the marginal strip 40 of the already secured pan section and concealing the heads of the securing screws 48. Each additional pan section is laid and secured on the roof in similar manner until the whole roof is covered.

The end pan section last laid on the roof will have only a side wall 34 and its edges will be formed as at 78 and 84 for engagement with a gable starter 22 and with an eave starter 24 in the manner above described.

The battens 52 thus formed are multi-walled and have great strength and rigidity to resist physical damage and to resist lifting by high wind.

As each pan section is secured by only one line of screws 48, the sections can be laid and secured in a minimum of time. Flat headed screws 48 are preferable so as to provide a uniform flat upper surface to the marginal securing strip 40, thus permitting the overlying pan section to lie flat with only a slight creasing due to the edge of the underlying marginal securing strip.

The embodiments of the invention in which an exclusive property or privilege is claimed are defined as follows:

1. For use in a metal roofing system of the batten type, a series of pan sections, each formed of a simple piece of prefolded sheet metal having an elongated central region and two parallel upstanding side walls, a first of said upstanding side walls extending upwardly at right angles to the central region of the pan section and then outwardly in a plane parallel to the central region of the pan section, and the second of said upstanding side walls extending upwardly at right angles to said central region, outwardly parallel to said central region and then downwardly a distance short of the plane of the central region of the pan section to form a hollow partial rectangle and then folded back on itself to lie against the upwardly, outwardly and downwardly extended portions to form double walls of the second upstanding side wall, a terminal portion of the sheet metal forming the said second side wall being extended outwardly from the upwardly extending portion of the second side wall in the plane of the central region of the pan section beyond the downwardly extending portion of the second side wall to form a narrow margin to receive fasteners for holding the pan sections to an underlying roof structure.

2. For use in a metal roofing system as set forth in claim 1 a series of pan sections in which said terminal portion of the sheet metal is folded upwards upon itself to form an upstanding longitudinal stop, the said stop being located within the batten structure adjacent to and parallel with the downwardly extending portion of the said second side wall, the said downwardly extending portion of the second wall and the said stop together holding the said first side wall of an adjacent interengaged pan section vertical and parallel with the upwardly extended portion of the said second side wall.

3. For use in a sheet metal roofing system as set forth in claim 2, a series of pan sections in which the overall width dimension of the said first wall of the pan section is slightly less than the internal width dimension of the said second wall for longitudinal sliding fit of the said first side wall of one pan section within the said second side wall of an adjacent pan section and between its downwardly extending portion and the said stop such that the upwardly extending portion of the first side wall is disposed inwardly of the downwardly extending portion of the second sidewall and outwardly of said stop.

4. For use in a sheet metal roofing system as set forth in claim 1, a series of pan sections in which the outwardly extending portion of the first upstanding side wall is folded downwards at right angles to lie parallel with and against the inner surface of the upwardly extending double wall of the second upstanding side wall of an adjacent interengaged second section.

5. For use in a sheet metal roofing system as set forth in claim 1, a series of pan sections in which the outwardly extending portion of the said second side wall is extended longitudinally beyond the ends of the formed battens and is foldable downwardly and inwardly to form a closure to the open end of a formed batten.

* * * * *